US005645450A

United States Patent [19]

Yamada et al.

[11] Patent Number: 5,645,450

[45] Date of Patent: Jul. 8, 1997

[54] SHIELDED CONNECTOR

[75] Inventors: Satoshi Yamada; Hisaharu Katoh; Norio Matsumura, all of Shizuoka, Japan

[73] Assignee: Yazaki Corporation, Tokyo, Japan

[21] Appl. No.: 562,989

[22] Filed: Nov. 27, 1995

[30] Foreign Application Priority Data

Nov. 29, 1994 [JP] Japan ..... 6-295068

[51] Int. Cl.[6] ..... H01R 4/66

[52] U.S. Cl. ..... 439/585; 439/610; 439/752.5

[58] Field of Search ..... 439/98, 595, 585, 439/752, 752.5, 578, 610, 733, 744, 746

[56] References Cited

U.S. PATENT DOCUMENTS 4,374,604 2/1983 Hemmer et al. ..... 439/595
4,386,816 6/1983 Frear et al. ..... 439/595
4,611,878 9/1986 Hall et al. ..... 439/610
5,352,126 10/1994 Kuboshima et al. ..... 439/89
5,368,504 11/1994 Muzslay et al. ..... 439/610
5,460,544 10/1995 Inaba et al. ..... 439/610
5,474,476 12/1995 Cheng ..... 439/675
5,489,222 2/1996 Moyer et al. ..... 439/578

*Primary Examiner*—Neil Abrams
*Assistant Examiner*—T. C. Patel
*Attorney, Agent, or Firm*—Sughrue, Mion, Zinn, Macpeak & Seas

[57] ABSTRACT

A male terminal is provided so that engagement protrusions formed on an inner housing engage with notches formed in a flange portion of the male terminal to thereby prevent the male terminal from rotating relative to a shielded cable around its axial line, and a metal shield is provided so that portions of the metal shield are fitted and locked into metal shield insertion holes formed among connection portions between an outer housing and the inner housing to thereby prevent the metal shield from rotating relative to the shielded cable around its axial line.

11 Claims, 5 Drawing Sheets

SHIELDED CONNECTOR

BACKGROUND OF THE INVENTION

1. Field of the invention

The present invention relates to shielded connectors for connecting shielded cables, and more particularly, relates to a technique for preventing contact failure at a caulking portion between shielding braid of a shielded cable and a metal shield covering and electromagnetically shielding the periphery of a portion to which core wire of the shielded cable is connected.

2. Related art

Conventionally, a shielded cable is constituted by a core wire through which an electric current flows and shielding braid formed from electrically conductive metal wires braided in the form of a net so as to cover the periphery of the core wire. At a portion where such shielded cables are connected to each other, there is a possibility that external electromagnetic noises may enter the core wires of the respective shielded cables because it is impossible to make shielding braid cover and electromagnetically shield the peripheries of the terminals which are fitted to each other to connect the respective core wires.

SUMMARY OF THE INVENTION

It is an object of the present invention to improve the shielded connector having a structure that no slip can be produced between the metal shields and the shielding braids respectively.

In order to achieve the above object, according to the present invention, the shielded connector in which periphery of a terminal connected to core wire of a shielded cable is covered to be electromagnetically shielded with a cylindrical metal shield which is connected to shielding braid of the shielded cable, wherein the terminal and the metal shield are locked to a connector housing so that the terminal and the metal shield are prevented from relatively rotating around an axis line of the shielded cable.

In the shielded connector according to the present invention, preferably, notches may be formed in a flange of the terminal so that the notches constitute engagement grooves which engage with flexible locking arms of the connector housing for fixedly locking the terminal, and that engagement protrusions which engage with the notches are provided so as to project on the connector housing.

Since the terminal fixed to the core wire of the shielded cable is engaged with the connector housing so as not to rotate relative to the connector housing, also the shielded cable cannot rotate relative to the connector housing around its axis line. Further, also the metal shield is engaged with the connector housing so as not to rotate relative to the connector housing. Accordingly, even if external torsional force is exerted onto the shielded cable, no relative rotational force is produced between the shielding braid and metal shield, and, therefore, slip can be prevented from occurring between the shielding braid and the metal shield.

DETAILED DESCRIPTION OF THE PREFERRED EMBODIMENTS

Figure 1:
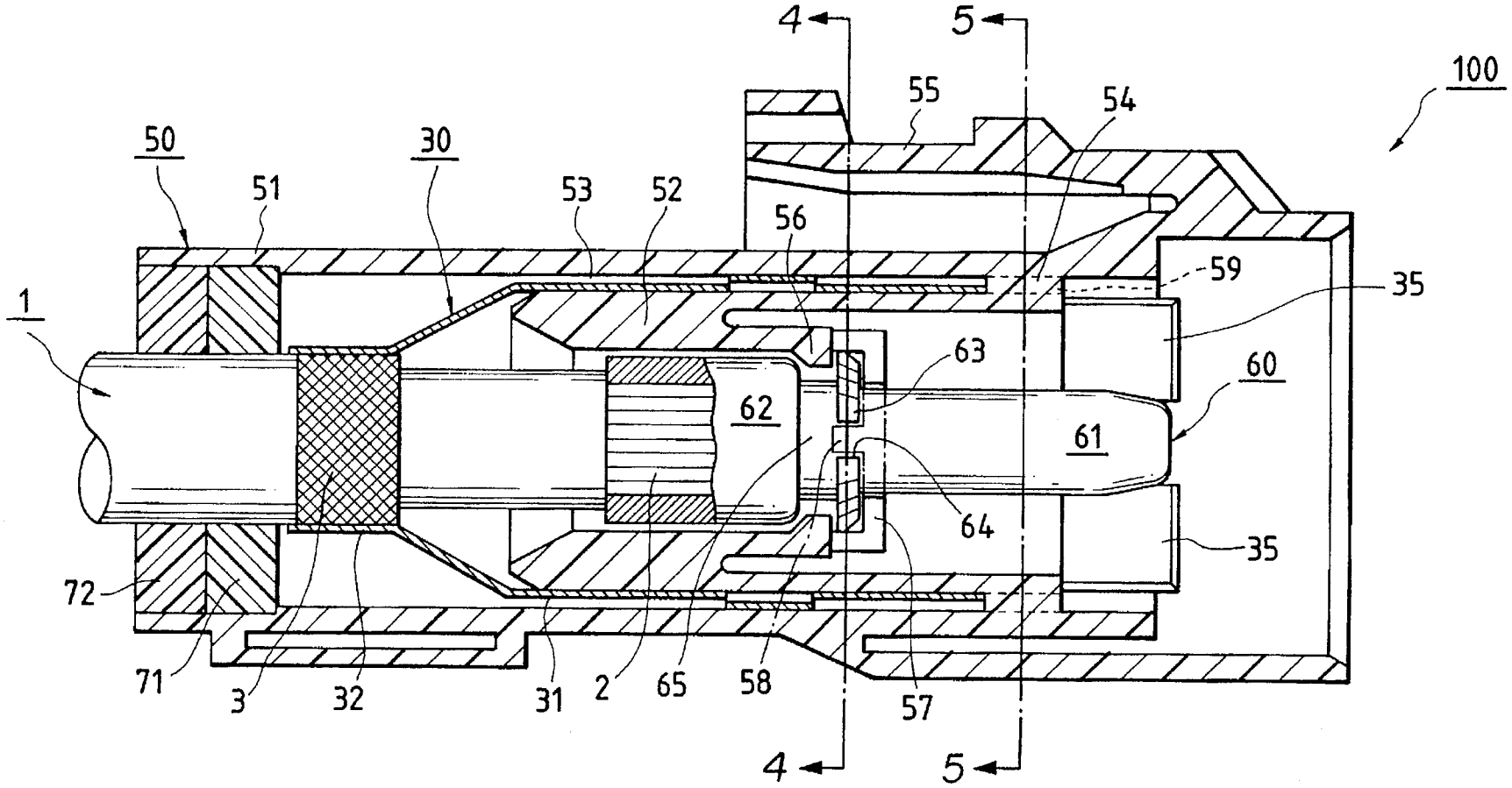
FIG. 1 is a whole sectional view showing an embodiment of the shielded connector according to the present invention.

Referring to the drawings, an embodiment of the shielded connector according to the present invention will be described below in detail.

First Embodiment

Figure 6:
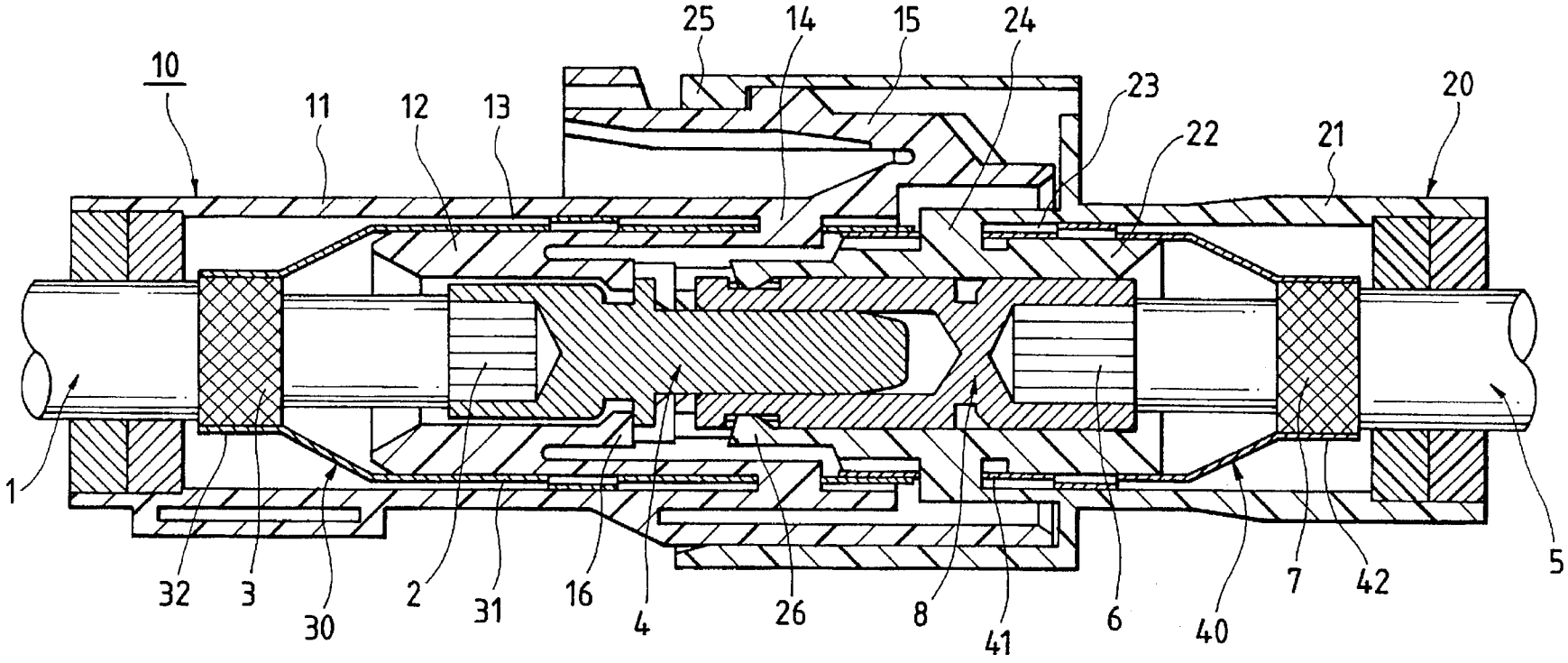
FIG. 6 is a whole sectional view showing a shielded connector of first embodiment of the present invention.

Referring to FIG. 6, a first embodiment of a shielded connector will be described. In the drawing, core wires 2 and 6 of shielded cables 1 and 5 are respectively connected to female and male terminals 4 and 8 which are fitted to each other. The terminals 4 and 8 are respectively received in cylindrical inner housings 12 and 22 respectively provided in housings 10 and 20, and the terminals 4 and 8 are locked respectively by housing lances 16 and 26 so as not to come off.

Further, small-diameter portions 32 and 42 of stepped cylindrical metal shields 30 and 40 press-formed from an electrically conductive metal plate are inserted onto shielding braids 3 and 7 of the shielded cables 1 and 5, respectively. Large-diameter portions 31 and 41 of the metal shields 30 and 40 are inserted into metal shield insertion gaps 13 and 23 formed between the inner housings 12 and 22 and substantially cylindrical outer housings 11 and 21 formed on the outside of the inner housings 12 and 22 coaxially therewith, respectively.

When the housings 10 and 20 are fitted to each other as shown in FIG. 6, the terminals 4 and 8 are fitted to each other so that the shielded cables 1 and 5 become conductive with each other, and at the same time, the large-diameter portions 31 and 41 of the metal shields 30 and 40 are fitted to each other to cover the peripheries of the terminals 4 and 8 to thereby electromagnetically shielding the entire terminals 4 and 8, respectively. Thus, external noises can be prevented from entering into the core wires 2 and 6, respectively, and, at the same time, noises due to currents flowing through the core wires 2 and 6 can be prevented from externally leaking, respectively.

The housings 10 and 20 can be produced inexpensively because the outer housing 11 and the inner housing 12 and the outer housing 21 and the inner housing 22 are integrally molded with resin, respectively. Further, the assembling property is superior because the metal shields 30 and 40 are inserted into the metal shield insertion gaps 13 and 23 formed between the inner housings 12 and 22 and the outer housings 11 and 21, respectively.

In the above-mentioned shielded connector, the substantially cylindrically formed outer housings 11 and 21 are connected to the respective inner housings 12 and 22 respectively through a plurality of connection portions 14 and a plurality of connection portions 24 which are respectively formed to radially extend in the metal shield insertion gaps 13 and 23. Since the connection portions 14 and 24 are circumferentially equidistantly provided in the respective metal shield insertion gaps 13 and 23, the forward end portions of the large-diameter portions 31 and 41 of the respective metal shields 30 and 40 are slit so that these portions do not interfere with the connection portions 14 and 24 respectively. Thus, the metal shields 30 and 40 circumferentially engage with the connection portions 14 and 24 so that the metal shields 30 and 40 do not displace circumferentially relative to the housings 10 and 20, respectively.

Second Embodiment

As shown in FIG. 1, a shielded connector 100 of a second embodiment is constituted by a female connector housing 50, a male terminal 60 fixed to core wire 2 of a shielded cable 1, and a metal shield 30 inserted onto shielding braid 3 of the shielded cable 1.

Figure 2:
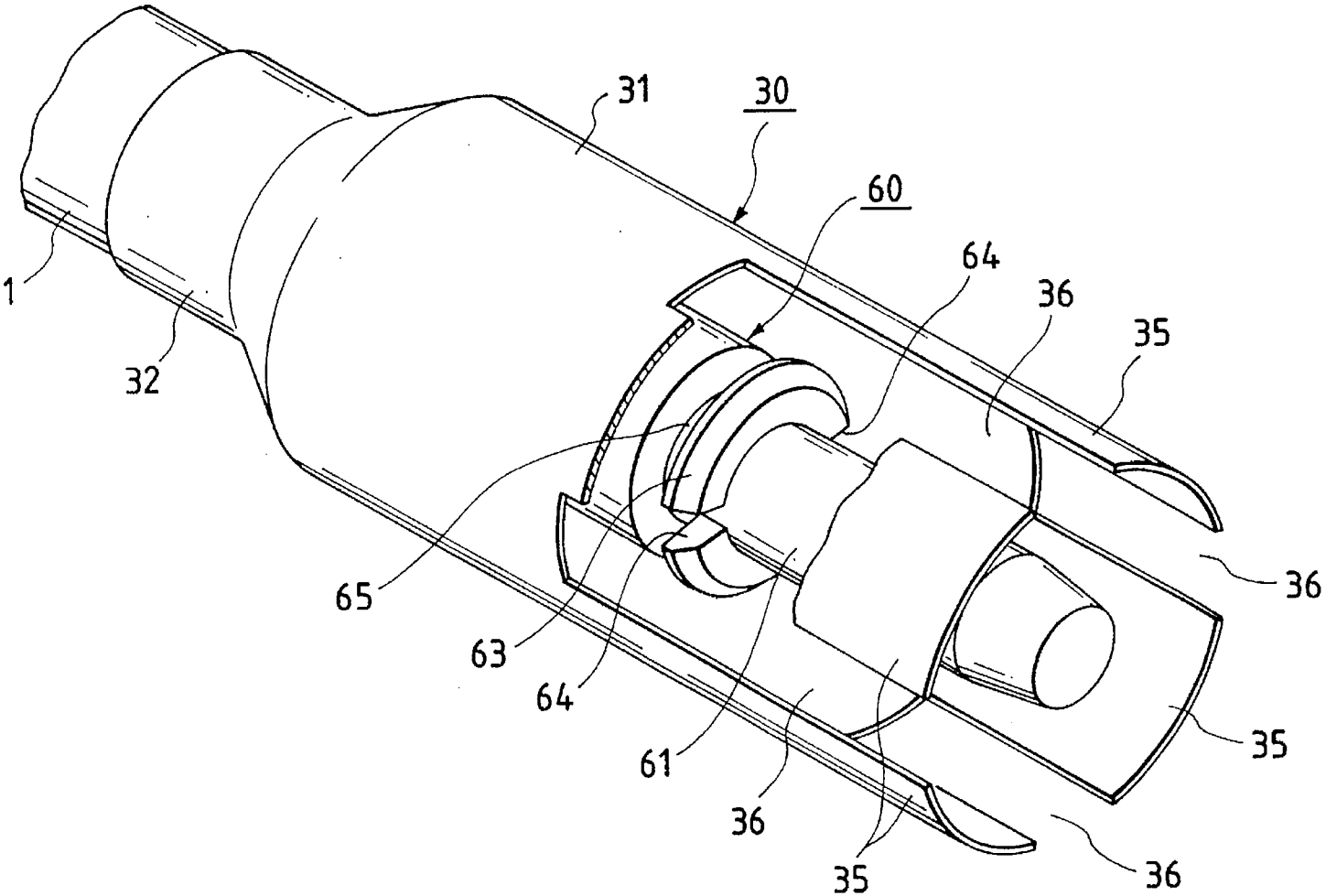
FIG. 2 is a perspective view of the shielded cable and the metal shield depicted in FIG. 1.
Figure 3:
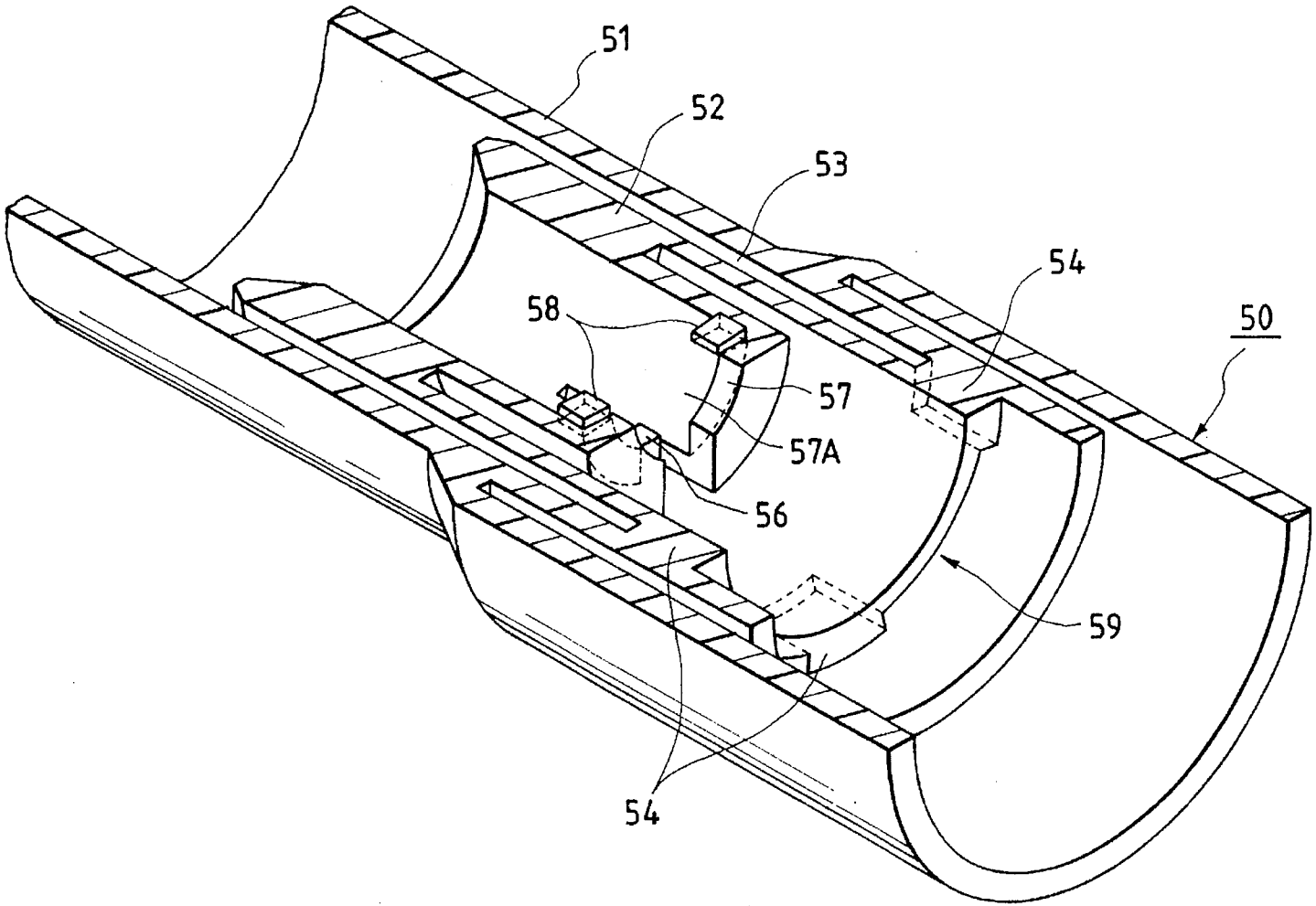
FIG. 3 a perspective view showing the female connector housing depicted in FIG. 1 in the state where the connector housing is broken horizontally.
Figure 4:
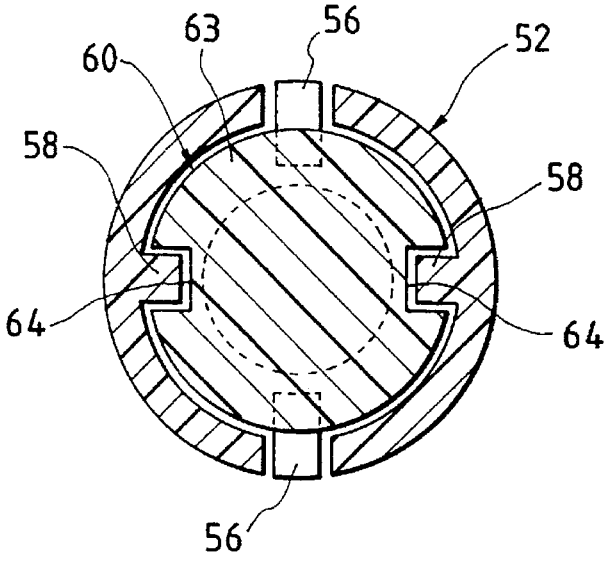
FIG. 4 is a main part sectional view along arrowheaded line 4—4 in FIG. 1.
Figure 5:
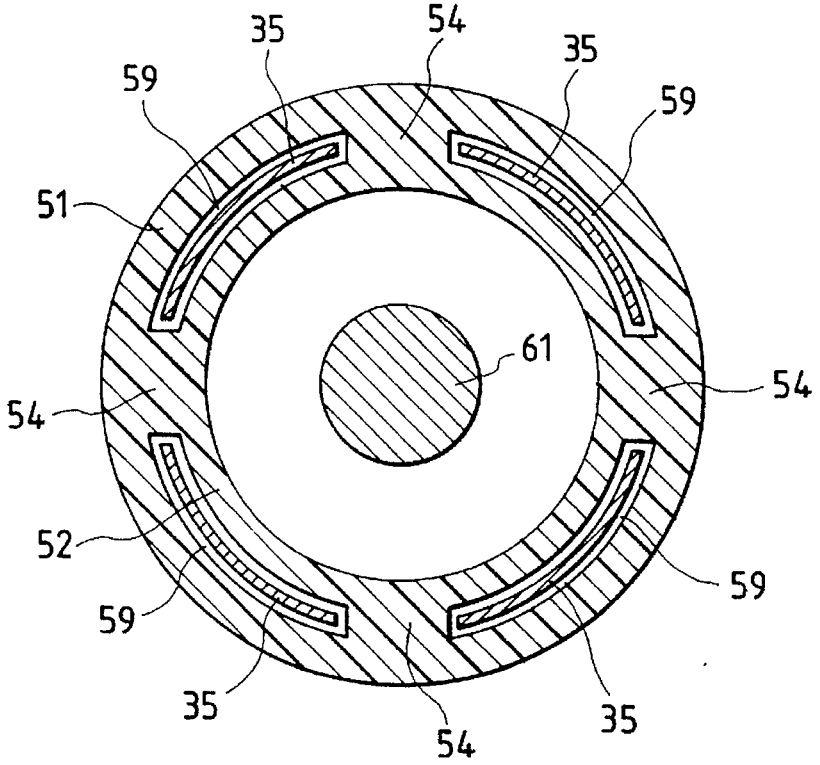
FIG. 5 is a main part sectional view along arrowheaded line 5—5 in FIG. 1.

The female connector housing 50 is formed through resin molding, and has a structure in which, as shown in FIGS. 1 and 3, a substantially cylindrical outer housing 51 is coaxially connected to an inner housing 52 through connection portions 54 provided in the front side of the connector and a metal shield insertion gap 53 is provided between the outer housing 51 and the inner housing 52. The connection portions 54 are provided circumferentially equidistantly at four positions so that respective gaps between these four connection portions 54 form metal shield insertion holes 59 into which forward portions 35 (see FIG. 2) of the metal shield 30 are inserted, as will be described later.

On an outer portion of the outer housing 51, a locking portion 55 is provided to lock a not-shown male connector housing which is to be fitted to the female connector housing 50 to thereby prevent the male connector housing from coming off. Further, on the rear end portion of the outer housing 51, a waterproof packing 71 and a retainer 72 are attached so that the waterproof packing 71 and the retainer 72 are mounted on the shielded cable 1 so as to be fitted onto the inner circumferential surface of the outer housing 51 to thereby close the inside of the housing liquid-tightly.

At the forward end of the inner housing 52, a front wall 57 is formed perpendicularly to the radial direction so as to terminate the inner housing 52. The front wall 57 has an insertion hole 57A through which an electricity connection portion 61 of the male terminal 60 can be inserted. A flange portion 63 is formed on the base portion of the electricity connection portion 61 of the male terminal 60 so as to be able to collide against the front wall 57 so that the male terminal 60 is axially positioned by the front wall 57.

Further, on the inner housing 52, as shown in FIGS. 1 and 3, a pair of flexible locking arms (hereinafter referred to as "lances") 56 are provided so as to halve the front wall 57, so that the lances 56 engage with engagement grooves 65 formed in the male terminal 60, as will be described later, to thereby prevent the male terminal 60 from coming off axially.

Furthermore, in the position on the inner side of the front wall 57 of the inner housing 52, a pair of engagement protrusions 58 are provided in positions opposite to each other so as to radially inwardly project so that the engagement protrusions 58 respectively engage with notches 64 of the male terminal 60, as will be described later, to thereby prevent the male terminal 60 from rotating circumferentially.

As shown in FIGS. 1 and 2, the male terminal 60 is constituted by the aforementioned electricity connection portion 61 which is formed columnar so as to fit with the female terminal of a mate connector, the aforementioned flange portion 63 provided on the base portion of the electricity connection portion 61 perpendicularly to the axial line of the latter, and a cylindrical closed-end electric-wire connection portion 62 which is caulked in a condition that the core wire 2 of the shielded cable 1 is inserted into the electric-wire connection portion 62 so that the core wire 2 is fixedly connected to the wire connection portion 62.

Further, in the male terminal 60, the aforementioned engagement grooves 65 are formed between the flange portion 63 and the electric-wire connection portion 62 so that the forward engagement ends of the lances 56 come into the engagement grooves 65 after the lances 56 have been elastically deformed.

Further, in the flange portion 63, the aforementioned pair of notches 64 are formed so as to be opposite to each other and so as to be radially inwardly notched from the outer circumferential surface of the flange portion 63.

As shown in FIGS. 1 and 2, the aforementioned metal shield 30 is press-formed into a stepped cylindrical shape from an electrically conductive metal plate in a manner so that the large-diameter portion 31 covers the periphery of the male terminal 60. In the large-diameter portion 31, notches 36 are formed in the forward end portion of the large-diameter portion 31 so as to extend axially at circumferentially equidistantly separated four positions so that remaining portions 35 of the forward end portion of the large-diameter portion 31 are formed like a four-pronged fork. The shielding braid 3 of the shielded cable 1 is made to cover the outside of the small-diameter portion 32 so that the small-diameter portion 32 is electrically connected to the shielding braid 3 of the shielded cable 1.

Next, the manner of assembling of the aforementioned constitutional members into a shielded connector will be described. When the male terminal 60 is inserted into the metal shield insertion gap 53 between the outer housing 51 and the inner housing 52, the engagement protrusions 58 provided on the front wall 57 of the inner housing 52 come into the notches 64 of the flange portion 63 so that the male terminal 60 is locked in the inner housing 52 so as to be prevented from rotating relative to the female connector housing 50 around the axial line thereof.

Further, the flange portion 63 of the male terminal 60 collides against the front wall 57 of the inner housing 52, and the lances 56 integrally formed on the inner housing 52 engage with the engagement grooves 65, so that the male terminal 60 is axially positioned and prevented from axially coming off so as to be fixed to the inner housing 52.

Further, the forward end portions 35, like a four-pronged fork, of the thus configured metal shield 30 are respectively fitted into the four metal shield insertion holes 59 formed between the four connection portions 54 which connect the outer housing 51 and the inner housing 52 to each other so that the metal shield 30 is locked onto the female connector housing 50 so as to be prevented from rotating around the axial line relative to the female connector housing 50.

Next, description will be made as to the state where torsional force is externally exerted onto the shielded cable 1 of the assembled shielded connector.

When torsional force is externally exerted onto the shielded cable 1, the core wire 2 and shielding braid 3 of the shielded cable 1 are urged to rotate integrally with each other. At this time, also the male terminal 60 fixed to the core wire 2 is urged to rotate together with the core wire 2, but the male terminal 60 cannot rotate around the axial line relative to the inner housing 52 because the notches 64 provided in the flange portion 63 of the male terminal 60 are in engagement with the respective engagement protrusions 58 provided on the inner housing 52, so that the shielded cable 1 is prevented from rotating around the axial line relative to the female connector housing 50.

Similarly to this, since the four-pronged fork portions 35 provided on the forward end portion of the metal shield 30 are circumferentially in engagement with the connection portions 54 connecting the outer housing 51 and the inner housing 52 coaxially to each other, the metal shield 30 is prevented from rotating around the axial line relative to the female connector housing 50.

Thus, since the shielded cable 1 and the metal shield 30 are integrally locked so as to be prevented from rotating around the axial line relative to the female connector housing 50, the relative rotation around the axial line between the shielding braid 3 of the shielded cable 1 and the small-diameter portion 32 of the metal shield 30 at the connection portion therebetween is prevented to thereby eliminate occurrence of the contact failure.

That is, in the shielded connector 100 according to the embodiment of the present invention, no slip is produced between the shielding braid 3 of the shielded cable 1 and the metal shield 30 fitted onto the outside of the shielding braid 3 so that, even if external torsional force is repeatedly exerted onto the shielded cable 1 in the state where the female connector housing 50 is fixed, the electrical conduction between the shielding braid 3 of the shielded cable 1 and the metal shield 30 is kept continuously and the electromagnetic shielding by means of the metal shield 30 is not deteriorated.

It is a matter of course that the shielded connector according to the present invention is not limited to the above embodiment but various modifications may be provided in accordance with the gist of the present invention.

For example, although the means for preventing the terminal 60 from coming off is constituted by engagement between the notches 64 formed in the flange portion 63 and the engagement protrusions 58 formed on the inner housing 52 in the embodiment described above, the present invention is not limited to this and the above-mentioned notches may be formed in the electricity connection portion 61 or in the electric wire connection portion 62 of the male terminal 60, or the sectional shape of the male terminal 60 may be made, for example, rectangular so that this male terminal 60 is engaged with the cylindrical inner housing 52 having a rectangular cross-section.

Alternatively, engagement protrusions may be formed on the outer circumferential surface of the male terminal 60 so as to project therefrom and the concave portions or notched grooves to be engaged with the engagement protrusions may be formed in the inner housing 52.

Further, although the description has been made, by way of example, about the case of the male terminal 60 and the female connector housing 50 in the embodiment of the present invention, it is a matter of course that the present invention may be applied to such a shielded connector constituted by a female terminal and a male connector housing as illustrated in FIG. 6.

According to the present invention, as described above, in a shielded connector in which periphery of a terminal connected to core wire of a shielded cable is covered to be electromagnetically shielded with a cylindrical metal shield which is connected to shielding braid of the shielded cable, the terminal and the metal shield are locked to a connector housing so that the terminal and the metal shield are prevented from relatively rotating around an axis line of the shielded cable. Accordingly, the shielded cable and the metal shield do not rotate relative to each other around the axial line of the shielded cable, so that even if external torsional force is repeatedly exerted onto the shielded cable in the state where the shielded cable is mounted on the connector housing, slip is prevented from occurring between the metal shield and the shielding braid at the connection portion therebetween to thereby continuously keep electromagnetic shielding by means of the metal shield.

What is claimed is:

1. A shield connector for shielding a terminal connected to a shield cable including a shield braid circumscribing a core conductor, said shield connector comprising:

a unitary connector housing;

a unitary metal shield connectable to said shield braid, said unitary metal shield substantially surrounding said terminal so as to electromagnetically shield said shield cable, said unitary metal shield and said terminal being removably insertable into said connector housing in an axially forward direction;

axial locking means for retaining said terminal within said connector housing to prevent axial movement of said terminal with respect to said connector housing; and rotation locking means for preventing said unitary metal shield and said terminal from rotating with respect to said connector housing.

2. The shield connector of claim 1, wherein said axial locking means includes a lance extending from said connector housing and a flange extending from said terminal, said flange being engaged by said lance when said terminal in disposed in said connector housing.

3. The shield connector of claim 1, wherein said connector housing includes an outer housing and an inner housing which is connected to said outer housing via a connecting portion, said inner and outer housing defining a gap therebetween in which a forward portion of said unitary metal shield is received.

4. The shield connector of claim 1, wherein said rotational locking means includes first locking means for preventing rotation of said terminal with respect to said connector housing and second locking means for preventing rotation of said unitary metal shield with respect to said connector housing.

5. The shield connector of claim 4, wherein said second locking means includes a plurality of prongs extending axially from said unitary metal shield in said forward direction and a corresponding plurality of insertion holes formed in said connector housing in which said plurality of prongs are respectively received.

6. The shield connector of claim 4, wherein said first locking means includes a flange provided on said terminal and having a notch therein, and an engagement protrusion attached to said housing which is receivable in said notch.

7. The shield connector of claim 6, wherein said axial locking means includes a lance extending from said connector housing and said flange provided on said terminal, said flange being engaged by said lance when said terminal in disposed in said connector housing.

8. A shield connector for shielding a terminal connected to a shield cable including a shield braid circumscribing a core conductor, said shield connector comprising:

a unitary connector housing; and a unitary metal shield connectable to said shield braid, said unitary metal shield substantially surrounding said terminal so as to electromagnetically shield said shield cable, said unitary metal shield and said terminal being removably insertable into said connector housing in an axially forward direction in such a manner that said unitary metal shield is prevented from rotating relative to said connector housing.

9. The shield connector of claim 8, wherein said connector housing includes a lance projecting therefrom which engages said terminal to prevent axial movement of said terminal in said connector housing.

10. The shield connector of claim 8, wherein said connector housing includes an outer housing and an inner housing which is connected to said outer housing via a plurality of circumferentially spaced connecting portions, said inner and outer housings defining an annular gap therebetween in which a forward portion of said unitary metal shield is received.

11. The shield of claim 10, wherein said forward portion of said unitary metal shield includes a plurality of finger-like projections extending in said forward direction which are separated by a plurality of openings, and wherein said connecting portions of said housing are received in said openings.

* * * * *